United States Patent [19]

O'Neill

[11] 4,153,395

[45] May 8, 1979

[54] COMPRESSORS

[75] Inventor: Peter A. O'Neill, Bearsden, Scotland

[73] Assignee: Howden Compressors Limited, Glasgow, Scotland

[21] Appl. No.: 830,017

[22] Filed: Aug. 30, 1977

[30] Foreign Application Priority Data

Sep. 4, 1976 [GB] United Kingdom ..... 36750/76

[51] Int. Cl.[2] ..... F04C 17/12; F04C 23/00; F04C 27/00; F04C 29/00

[52] U.S. Cl. ..... 418/9; 418/15; 418/95; 418/104; 418/201

[58] Field of Search ..... 418/9, 15, 95, 97–100, 418/102, 104, 201; 277/3, 15, 29, 59

[56] References Cited

U.S. PATENT DOCUMENTS

| | | | |
|---|---|---|---|
| 3,178,104 | 4/1965 | Williams et al. | 418/98 |
| 3,265,293 | 8/1966 | Schibbye | 418/9 |
| 3,307,453 | 3/1967 | Nilsson et al. | 418/98 |
| 3,918,854 | 11/1975 | Denis | 277/3 |
| 3,975,123 | 8/1976 | Schibbye | 418/102 |

FOREIGN PATENT DOCUMENTS

| | | | |
|---|---|---|---|
| 580019 | 8/1924 | France | 418/102 |
| 275726 | 8/1927 | United Kingdom | 277/15 |

*Primary Examiner*—John J. Vrablik

*Attorney, Agent, or Firm*—Mason, Fenwick & Lawrence

[57] ABSTRACT

In screw compressors for fluids there is normally leakage of fluid axially through the rotor-shaft bearing assemblies at the high-pressure end of the casing housing the interacting rotors. To obviate or mitigate the resulting inefficiency in the operation of the compressor, and also reduce atmosphere pollution arising from the leakage, a fluid coupling is provided between said bearing assemblies and an additional fluid inlet opening in the compressor casing, said additional opening being positioned to communicate with a land of the rotor when the rotor is at or beyond rotor cut-off, so that fluid leaking from the compression chamber is recirculated to the compression chamber.

6 Claims, 4 Drawing Figures

Fig. 1.
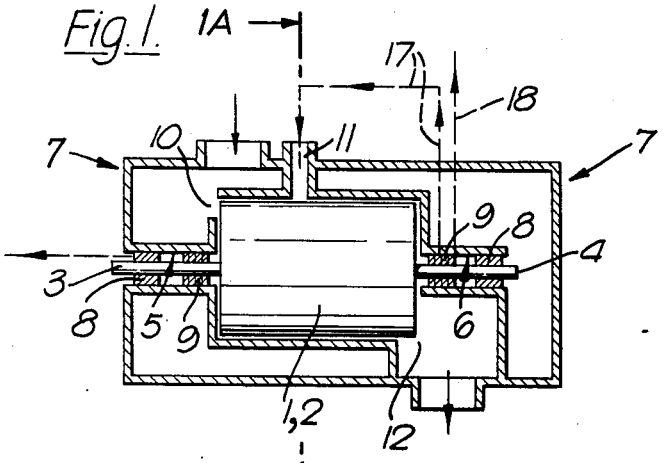
Fig. 2.
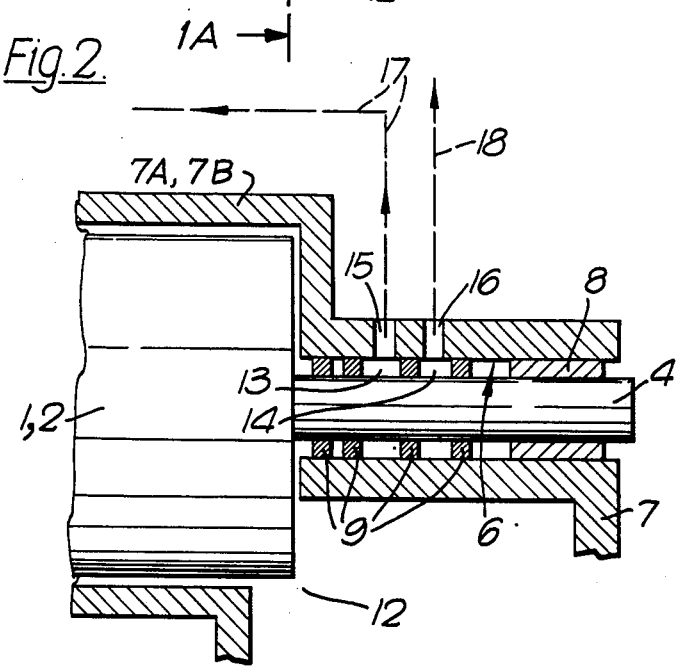
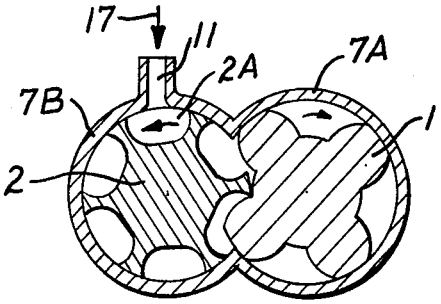
Fig. 1A.

COMPRESSORS

The present invention concerns improvements in or relating to gas-pressurizing apparatus, and concerns particularly such apparatus which includes a gas compressor having two interacting screw rotors in a common casing.

A known apparatus includes an interacting-screw gas compressor comprising two interacting rotors, a male rotor and a female rotor, having thereon shafts mounted in bearings in bores in the common casing. The male rotor includes a series of helically disposed lobes which mesh with corresponding helical grooves in the female rotor to form compression chambers. In operation, gas to be compressed is admitted to a groove in the female rotor by way of an inlet port in the end of the casing when the rotors have rotated such that the said groove and inlet are in fluid communication. Further rotation causes the end of said groove to move progressively behind a masking inlet plate thereby sealing off the gas in the groove. The position of the rotors at the instant when the groove becomes completely sealed off shall be referred to hereinafter as "rotor cut-off" and the gas in the groove at rotor cut-off will be at or very slightly above inlet pressure.

With such screw compressors it is found that the gas being compressed can leak in axial flow outwards through the casing bores housing the shafts. This leakage usually occurs through the casing bores at the outlet end of the casing where high pressures are encountered, but can also occur at the inlet end of the casing, especially when the inlet pressure is above the ambient pressure.

Clearly, any leakage is disadvantageous as it reduces the efficiency of the compressor and furthermore, if the gas is toxic or flammable, can cause pollution difficulties.

It is an object of the present invention to obviate or mitigate these disadvantages.

According to the present invention there is provided a gas-pressurizing apparatus comprising an interacting-screw gas compressor having interacting male and female rotors whereof shafts are mounted in bearings in bores in a common casing having therein a gas inlet opening, a gas outlet opening, and an additional gas inlet opening communicating with a groove of the female rotor when said rotor is at or beyond rotor cut-off, and conduit means connecting the casing bores at the high-pressure end of the casing to the additional inlet opening in the casing so that gas leaking from the compression chamber into said casing bores flows from said casing bores into the compression chamber.

Preferably, said casing bores have therein a plurality of axially spaced sealing rings between the rotors and the bearings, and the conduit means extend from the annular spaces formed in the bores between pairs of adjacent sealing rings.

Preferably also said bores have ducting connected thereto at a location between the conduit means and the bearings to receive any residual leakage gas flowing past the conduit means.

Preferably also the ducting is vented to atmosphere.

Further according to the present invention the apparatus includes a further interacting-screw gas compressor connected in series fluidwise with the first interacting-screw gas compressor for multi-stage compression of the gas, said further gas compressor having the casing bores at either or both of its ends, instead of or in addition to said casing bores of the first gas compressor, connected to the additional inlet opening of the first gas compressor.

Embodiments of the invention will now be described by way of example with reference to the accompanying diagrammatic drawings in which:

FIG. 1 is a sectional side view of gas pressurizing apparatus;

FIG. 1A is a fragmentary cross-sectional view on the line 1A—1A of FIG. 1;

FIG. 2 is an enlarged fragmentary sectional side view showing an outlet-end bearing of the machine of FIG. 1;

Figure 3:
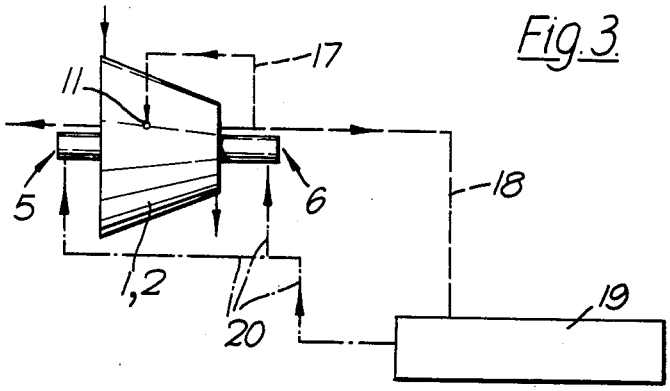
FIG. 3 is a diagram showing an alternative form of leakage-gas disposal.

Referring to FIGS. 1, 1A and 2, a pair of interacting male and female rotors 1, 2 operable in a working space formed by a pair of intersecting cylindrical portions 7A and 7B of a common casing 7, have end shafts 3 and 4 journalled in cylindrical bores 5 and 6 in the casing 7 at the ends of the cylindrical portions. Each bore houses an outer oil-lubricated sleeve bearing 8 (FIG. 2) and an inner set of four axially spaced sealing rings 9 serving to resist leakage of gas through the bores. Each sealing ring 9 is formed of a steel backing ring shrunk on to a carbon ring. The casing 7 is provided with a fluid inlet port 10 communicating with a groove 2A in the rotor 2, and the wall of the cylindrical portion 7B is provided with an additional fluid inlet port 11 which communicates with said groove 2*a* at the instant the rotor 2 is at, or after the rotor 2 is in the rotor cut-off position. The casing 7 is also provided with a fluid outlet port 12. An interacting-screw gas compressor whereof the casing has an additional gas inlet port similar to the port 11 is described and shown in our British patent specification No. 1335025. However, the invention set forth in said specification is quite separate and distinct from the present invention.

In operation of the foregoing apparatus there is normally leakage of pressurized gas from the compression chamber axially outwards through the casing bores 5 and 6, and this leakage would normally give rise to the disadvantages previously recited. However, in the present instance in each casing bore 6 when the leakage gas enters successively the annular spaces 13 and 14 defined by the sealing rings 9 (FIG. 2), it is led from the bore through axially spaced radial conduits 15 and 16 formed by drilling through-holes in the wall of the bore to provide communication with the respective spaces 13 and 14. A pipe 17 connects the conduit 15 to the additional inlet port 11 while a pipe 18 connected to the conduit 16 vents the space 14 to atmosphere so that any residual leakage gas, that is leakage gas not flowing to the additional inlet 11, is allowed to pass to atmosphere.

In operation of the apparatus, any high-pressure gas leaking from the compression chamber through the casing bores 6 at the high-pressure end of the compressor is recirculated to the additional inlet 11 of the compressor. With this arrangement leakage of gas from the compressor is mitigated. Furthermore, the fact that the high-pressure leakage gas is not introduced directly into the compressor through the usual inlet port 10, means that advantageously the density of the gas at the inlet port 10 is not reduced, nor is the suction volume reduced.

Referring to FIG. 3, the bearings at the outer end of the casing bores 5 and 6 housing the shafts of the compressor having an additional inlet port 11, are fed with lubricating oil by means of a lubricating circuit including a sealed oil-tank 19 and pipes 20 extending between the tank and the bearings. To avoid atmospheric pollution arising from the discharge of residual leakage gas to atmosphere, the pipe 18 for discharge of the residual leakage gas is connected to the sealed tank 19. This anti-pollution arrangement is an improvement over an anti-pollution arrangement in which the entire leakage flow enters the tank, as the tank in the present case is in communication with the additional gas inlet port through the pipe 17 and is therefore maintained at or just above the suction pressure of the compressor and not at the discharge pressure of the compressor.

Figure 4:
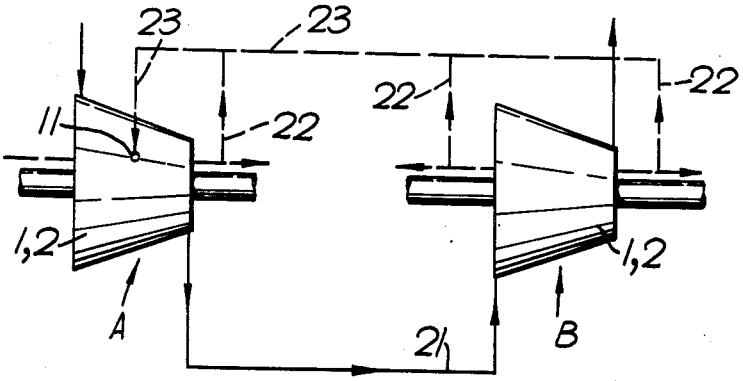
FIG. 4 is a diagram of gas-pressurizing apparatus embodying a plurality of interacting-screw gas compressors interconnected for serial flow of gas.

Referring to FIG. 4, the gas-pressurizing apparatus includes low and high pressure interacting-screw gas compressors respectively A and B interconnected for serial flow of gas by a pipe 21 extending between the outlet port of compressor A and the inlet port of compressor B. The compressor A has an additional inlet port 11. The gas leakage along the casing bores of the high-pressure compressor B is combined with the gas leakage along the casing bores at the high-pressure end of the compressor A by branch pipes 22 connected to a manifold pipe 23, and the pipe 23 is connected to the additional inlet port 11 of the compressor A. In a modification of this arrangement, the bores at either end of the compressor B instead at both ends are connected to the manifold pipe 23, while in a further modification the pipe connection between the high-pressure bores of compressor A and the manifold pipe 23 is omitted. In yet another modification, this arrangement is a multi-stage apparatus including more than two interacting-screw gas compressors connected in series fluidwise.

I claim:

1. An interacting-screw gas compressor comprising a casing having a pair of intersecting cylindrical portions forming a working space, gas inlet and outlet openings at the respective ends of the working space, and a pair of axially extending end bores disposed at the outlet end of the working space, a pair of male and female rotors housed in the respective cylindrical portions of the casing, said rotors having respectively lobes and grooves for interaction to form gas compression chambers and having a pair of end shafts extending into said pair of end bores, a pair of bearings disposed in the outer end portions of said end bores and supporting said pair of end shafts, an additional gas inlet opening formed in the cylindrical portion housing the female rotor to provide communication with a groove of the female rotor when said rotor is at or beyond rotor cut-off, and conduit means connecting inner end portions of said end bores to said additional gas inlet opening so that pressurized gas leaking from a compression chamber into said end bores flows from said end bores into a compression chamber.

2. An interacting-screw compressor according to claim 1, wherein the casing includes end tubular formations whereof the bores constitute said end bores and each of the end bores has in the inner end portion thereof a plurality of axially spaced sealing rings defining a pair of upstream and downstream annular spaces surrounding the end shaft and serving to receive respectively leakage gas and residual leakage gas, and each of the end tubular formations has in the wall thereof a pair of axially spaced through holes communicating respectively with the upstream and downstream annular spaces, the through hole communicating with the upstream annular space being also in communication with the additional gas inlet opening, and the through hole communicating with the downstream annular space being also in communication with the atmosphere.

3. An interacting-screw compressor according to claim 1, including a sealed oil tank connected to the bearings in the end bores to provide for lubrication of said bearings, and wherein each of the end bores has in the inner end portion thereof a plurality of axially spaced sealing rings defining a pair of upstream and downstream annular spaces surrounding the end shaft and serving to receive respectively leakage gas and residual leakage gas, and each of the end tubular formations has in the wall thereof a pair of axially spaced through holes communicating respectively with the upstream and downstream annular spaces, the through hole communicating with the upstream annular space being in communication with the additional gas inlet opening also, and the through hole communicating with the downstream annular space being in communication with the oil tank also.

4. Multi-stage gas compressing apparatus comprising first and second interacting-screw gas compressors each including a casing having a pair of intersecting cylindrical portions forming a working space, gas inlet and outlet openings at the respective ends of the working space, and pairs of axially extending end bores at the respective ends of the working space, a pair of male and female rotors housed in the respective cylindrical portions of the casing, said rotors having respectively lobes and grooves for interaction to form gas compression chambers and having pairs of end shafts extending into said pairs of end bores, and pairs of bearings disposed in the outer end portions of said end bores and supporting said pairs of end shafts, ducting connecting the outlet opening of the first compressor with the inlet opening of the second compressor, an additional gas inlet opening formed in the cylindrical casing portion of the first compressor housing the female rotor to provide communication with a groove of the female rotor when said rotor is at or beyond rotor cut-off, and conduit means interconnecting on the one hand the inner end portions of the end bores at the inlet and outlet ends of the second compressor and at the outlet end of the first compressor and on the other hand said additional gas inlet opening in the first compressor so that pressurized gas leaking from compression chambers into said end bores flows from said end bores into a compression chamber.

5. Apparatus according to claim 4, wherein the casing includes end tubular formations whereof the bores constitute said end bores, each of the end bores connected to the additional gas inlet opening has in the inner end portion thereof a plurality of axially spaced sealing rings defining a pair of upstream and downstream annular spaces surrounding the end shaft and serving to receive respectively leakage gas and residual leakage gas, and each of the end tubular formations has in the wall thereof a pair of axially spaced through holes communicating respectively with the upstream and downstream annular spaces, the through hole communicating with the upstream annular space being also in communication with the additional gas inlet opening.

6. Apparatus according to claim 5, wherein the through hole communicating with the downstream annular space is also in communication with the atmosphere.

* * * * *